US010024072B2

(12) United States Patent
Ferrari

(10) Patent No.: US 10,024,072 B2
(45) Date of Patent: Jul. 17, 2018

(54) THEATER HOUSE

(71) Applicant: Valerio Maria Ferrari, Milan (IT)

(72) Inventor: Valerio Maria Ferrari, Milan (IT)

( * ) Notice: Subject to any disclaimer, the term of this patent is extended or adjusted under 35 U.S.C. 154(b) by 0 days.

(21) Appl. No.: 15/555,638

(22) PCT Filed: Mar. 9, 2016

(86) PCT No.: PCT/EP2016/054958
§ 371 (c)(1),
(2) Date: Sep. 5, 2017

(87) PCT Pub. No.: WO2016/142396
PCT Pub. Date: Sep. 15, 2016

(65) Prior Publication Data

US 2018/0044933 A1 Feb. 15, 2018

(30) Foreign Application Priority Data

Mar. 10, 2015 (IT) ..... UB2015A0254

(51) Int. Cl.
*E04H 3/28* (2006.01)
*E04H 3/22* (2006.01)

(52) U.S. Cl.
CPC ..... *E04H 3/28* (2013.01); *E04H 3/22* (2013.01)

(58) Field of Classification Search
CPC ..... E04H 3/28; E04H 3/22
See application file for complete search history.

(56) References Cited

U.S. PATENT DOCUMENTS 892,600 A * 7/1908 Littman ..... E04H 3/28 52/7
1,018,499 A * 2/1912 Isner ..... E04H 3/28 52/7
1,896,652 A * 2/1933 Carmine ..... E04H 3/28 472/75
3,168,761 A * 2/1965 Graf ..... E04H 3/22 297/243
3,181,203 A * 5/1965 Wenger ..... E04B 1/34336 248/354.6
3,210,895 A * 10/1965 Graf ..... E04H 3/22 52/6

(Continued)

FOREIGN PATENT DOCUMENTS

DE 235274 C 3/1908
DE 3034867 A1 4/1982

(Continued)

OTHER PUBLICATIONS

Stageright website (Year: 2017).*

(Continued)

*Primary Examiner* — Brent W Herring
(74) *Attorney, Agent, or Firm* — Vorys, Sater, Seymour and Pease LLP

(57) ABSTRACT

A theater house includes a stage and stalls; the stage and the stalls include respective elongated portions located side by side and alternating to each other; the stage being at a greater height with respect to the stalls; a roofing is movable between a retracted configuration wherein it uncovers the stalls and an extended configuration wherein it covers the stalls thus defining a further walking surface adjacent to the stage.

20 Claims, 4 Drawing Sheets

(56) References Cited

U.S. PATENT DOCUMENTS

| | | | | |
|---|---|---|---|---|
| 3,258,884 | A * | 7/1966 | Wenger | E04H 3/22 52/182 |
| 5,319,895 | A | 6/1994 | Ray | |
| 7,172,245 | B2 * | 2/2007 | Bouchard | A47C 1/126 297/217.7 |
| 7,337,583 | B1 * | 3/2008 | Lohman | E04H 3/123 52/183 |
| 7,845,119 | B2 * | 12/2010 | Black | E04G 1/36 182/138 |
| 9,200,462 | B2 * | 12/2015 | Valente | E04H 3/123 |
| 9,764,246 | B2 * | 9/2017 | Fox | A63G 31/02 |
| 2011/0290588 | A1 * | 12/2011 | Hall | E04B 1/003 182/113 |
| 2013/0333302 | A1 * | 12/2013 | Valente | E04H 3/123 52/7 |
| 2014/0311046 | A1 * | 10/2014 | Ramirez Magana | E04H 3/22 52/8 |

FOREIGN PATENT DOCUMENTS

| | | | | |
|---|---|---|---|---|
| EP | 590767 | A2 * | 4/1994 | E04H 3/28 |
| FR | 2687713 | A1 | 8/1993 | |
| JP | 04360969 | A * | 12/1992 | E04H 3/126 |

OTHER PUBLICATIONS

Staging Dimensions website (Year: 2017).*
International Search Report and Written Opinion dated Jun. 8, 2016 for PCT/EP2016/054958 to Valerio Maria Ferrari filed Mar. 9, 2016.
Italian Search Report dated Oct. 27, 2015 for IT UB20150254 to Valerio Maria Ferrari filed Mar. 10, 2015.

* cited by examiner

THEATER HOUSE

CROSS-REFERENCE TO RELATED APPLICATIONS

This is a § 371 National Stage Application of International Application No. PCT/EP2016/054958 filed on Mar. 9, 2016, claiming the priority of Italian Patent Application No. UB2015A000254 filed on Mar. 10, 2015.

The scope of present invention is a theater house.

Specifically, the present invention relates to a theater house wherein the space reserved for the stage (or stage box) and the space reserved for the stalls alternate to each other, preferably a plurality of times.

More specifically, a set of portions of stage and a set of portions of stalls follow one aside the other. Just as an example, the portions of stage alternate to the portions of stalls in a number of times ranging from a minimum of two to a maximum of five.

The theater houses of the known type comprise stages and stalls for the audience that are distinct and not modifiable.

In this way, the structure, even though suitable for a certain type of performances, might be completely unfit for other types of shows or events.

However, the known theater houses cannot be adapted in a simple, fast, and economical manner.

As a matter of fact, any changes in the stage-to-stalls ratio would entail structural modifications which are long and extremely expensive indeed.

On the other hand, any attempts to modify such ratio would entail closing the theater house up to fully performing the modification works with evident further disadvantages.

In this context, the technical task underlying the present invention is providing a theater house that overcomes the above-mentioned drawbacks of the known art.

In particular, an object of the present invention is to provide a theater house that is capable of being adapted to different show requirements in a fast, simple, and economical manner.

The mentioned technical task and the specified object are substantially achieved by a theater house featuring the technical characteristics set forth in one or several of the attached claims.

Further features and advantages of the present invention will be more apparent from the explanatory, hence not limitative, description of a preferred but not exclusive embodiment of a theater house, as illustrated in the attached drawings wherein.

Figure 1:
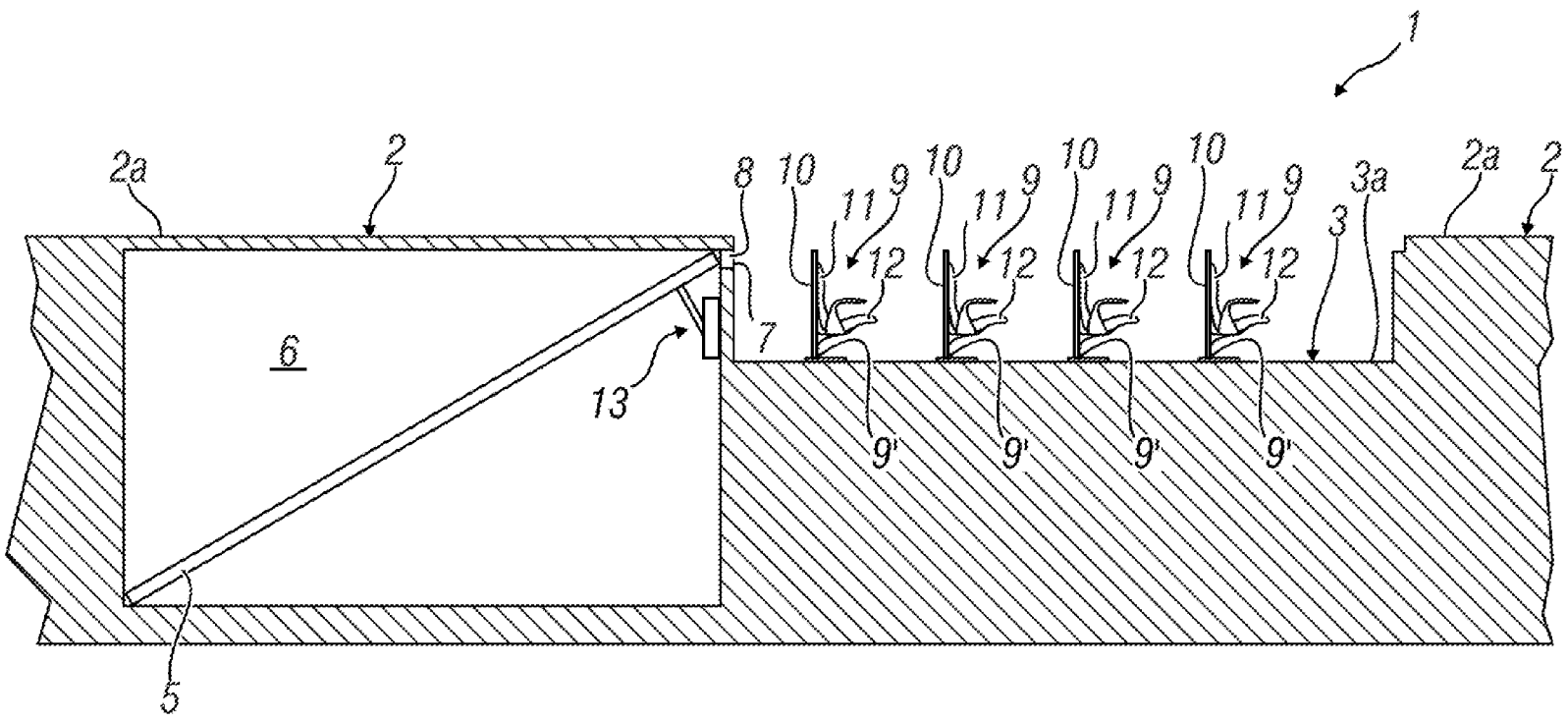
FIG. 1 is a schematic cross-sectional representation of a theater house according to a first operating condition in accordance with the present invention.

With reference to the attached figures, the reference numeral 1 identifies a theater house in accordance with the present invention.

A theater house 1 comprises a stage 2 destined for being used by performers or other users to put a show on the stage. The stage 2 comprise its own walking surface 2*a*.

The theater house 1 also comprises stalls 3 destined for being occupied by the audience. The stalls 3 feature a respective walking surface 3*a*.

The stage 2 and the stalls 3 feature respective elongated portions which lay side by side and alternate to each other.

In other words, the stage 2 and the stalls 3 are configured in such a way that every portion of stalls 3 has portions of stage 2 running side by side on its own opposite sides.

Figure 2:
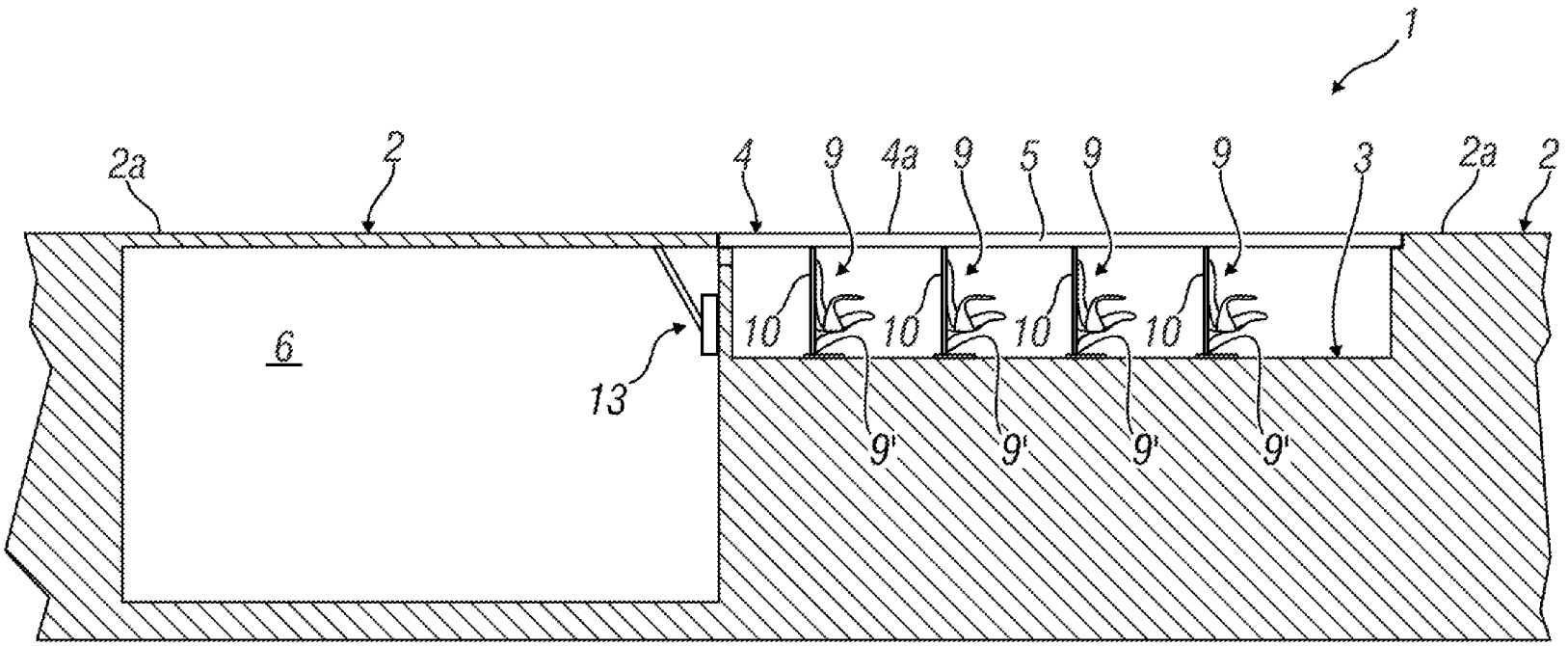
FIG. 2 is a schematic cross-sectional representation of the theater house of FIG. 1 according to a second operating condition.
Figure 3:
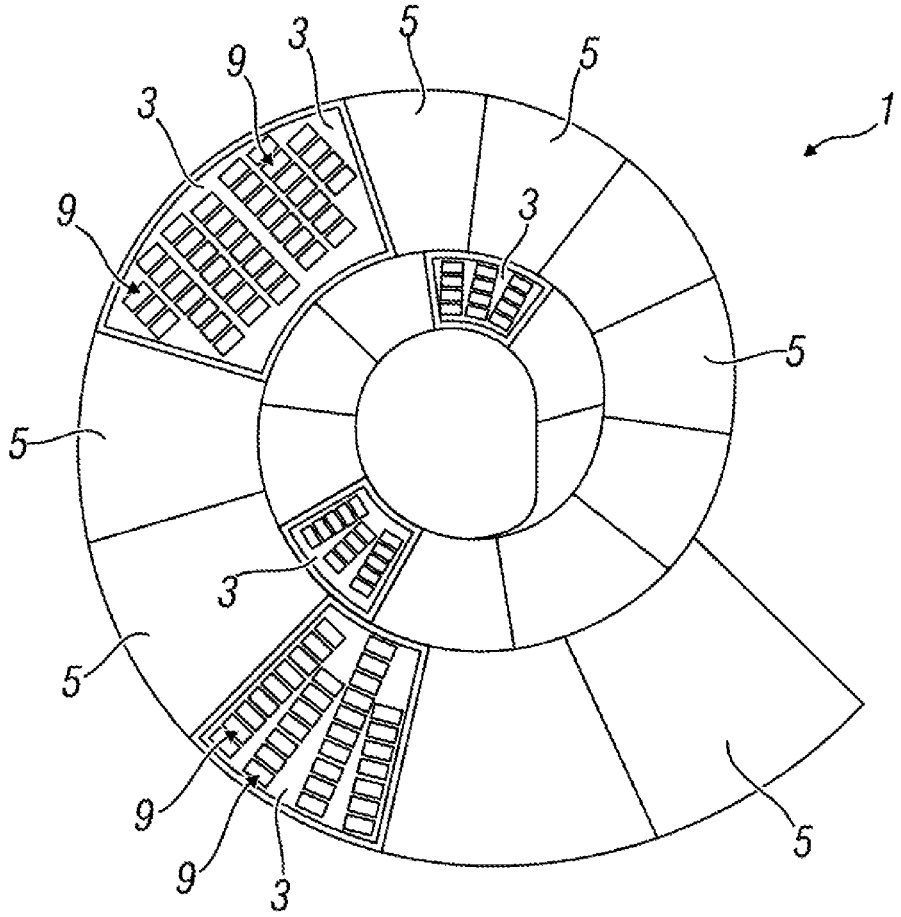
FIG. 3 is a top view representation of a theater house having stalls disposed in a spiral course.
Figure 4:
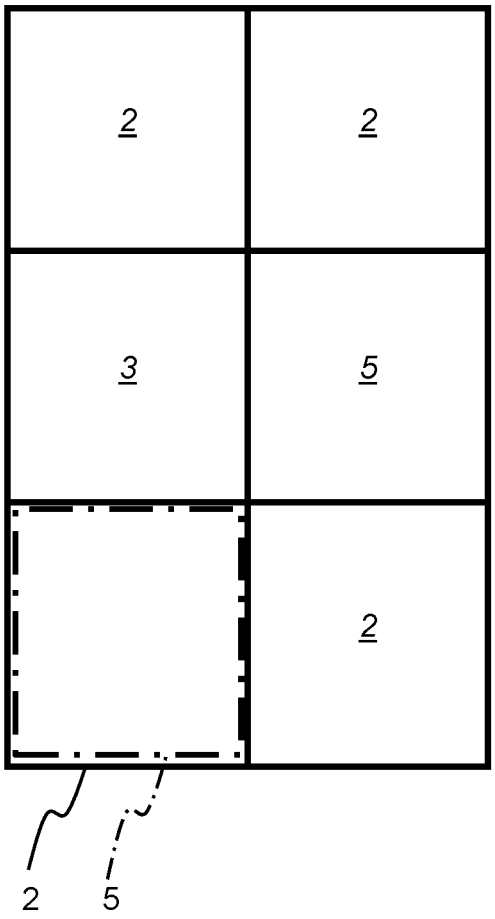
FIG. 4 shows a top view representation of a theater house wherein a set of portions of stage and a set of portions of stalls follow one aside another.

In the preferred embodiment, the stage 2 and the stalls 3 develop according to respective spiral courses, as shown in FIG. 3. The spires that define the stage 2 and the spires that define the stalls 3 are placed side by side to each other. FIG. 4 shows a set of portions of stage 2 and a set of portions of stalls 3 (with seats omitted for clarity) which follow one aside another. FIG. 4 shows the portions of stage alternate to the portions of stalls 3 wherein one panel 5 is shown in the retracted position under a portion of stage 2 to expose a portion of stall 3 consistent with FIG. 1 and one panel 5 is shown in the extended position to cover a portion of stall 3 consistent with FIG. 2.

In all cases, the walking surface 2*a* of the stage 2 is at a greater height than the walking surface 3*a* of the stalls 3.

In accordance with the present invention, the theater house 1 comprises a movable roofing 4 which can assume two configurations.

In a retracted configuration, the roofing 4 uncovers the stalls 3 which consequently can assume its basic function of receiving the audience.

In an extended configuration, the roofing 4 covers the stalls 3 and defines a further walking surface 4*a* adjacent to the stage 2 and in particular to the walking surface 2*a* of the stage 2.

In this way, advantageously can the roofing 4 convert stall positions 3 into further stage spaces according to the needs.

The roofing 4 comprises a plurality of panels 5 movable between a first position (or non-operating position) and a second position (or operating position).

The panels 5 are preferably made from wood. In other, also preferred, embodiments, the panels 5 can be made from any desired material that is suitable for this purpose.

In the first position, the panels 5 are retracted and lay under a portion of stage 2. In this way, they define the retracted configuration of the roofing 4 and the stalls 3 perform the function of receiving the audience.

In the second position, the panels 5 are extended and are put above a portion of stalls 3, thus covering it. In this position, they define the extended configuration of the roofing 4 and do not allow the stalls 3 to receive the audience. Moreover, in this position the panels 5 also define a further walking surface 4*a* of the roofing 4, thus extending the stage space beyond that defined by the stage 2.

With reference to the first position of the panels 5, the stage 2 presents a plurality of housing spaces 6 for housing the panels 5. The housing spaces 6 are derived under the walking surface 2*a* of the stage 2.

Openings 7 make it possible for the respective panels 5 to go out. The openings 7 can also be provided with doors 8 openable to make the panel 5 go out and closable to close the housing spaces 6 whenever the panels 5 are set to the first position.

Accordingly, as said above, every stall position 3 is located between two respective stage positions 2 at the respective sides.

Every panel 5, in the second position, extends from a first portion of stage 2 to a second portion of stage 2 opposite to the first one with respect to the portion of stalls 3 comprised therebetween.

More specifically, the panels 5 contained in their respective housing spaces 6 arranged under the first portion of stage 2 are extracted toward the second portion of stage 2 which they rest on, in the second position.

Handling members 13 operate onto the panels 5 to move them from the first position to the second position and vice versa.

Handling members 13 can be of electrical, hydraulic, or other types. Such members might also be of a manual type.

The theater house 1 also comprises a plurality of seats 9 for the audience, arranged in the stalls 3. Specifically, they are swivelingly secured to the walking surface 3*a* of the stalls 3 via swiveling securement 9'.

The seats 9 are equally spaced from each other and put at a mutual distance ranging from 70 cm to 100 cm.

In accordance with the present invention, the panels 5, when set to the second position, rest on at least one of the seats 9.

In this way, the seats 9 also perform a structural function with reference to the panels 5 which are better supported.

For this purpose, the seats 9 comprise an upright 10 each orthogonally secured to the walking surface 3*a* of the stalls 3.

The upright 10 performs a structural function and, whenever the panel 5 is resting thereon, it transfers the load of the panel 5 itself to the stalls 3.

Every seat 9 also comprises a back 11 and a seat 12 secured to the upright 10.

Finally, the seats 9 comprise multimedia devices (not illustrated in the attached figures) to supply the audience with audiovisual contents supporting the performance in progress.

The so described invention achieves the aimed at purpose.

As a matter of fact, the roofing can be preset at will and in an extremely fast and simple manner so as to make it possible to modulate the spaces destined for the stage and those destined for the audience in an extremely simple manner.

It is worth noting that any configurations of the roofing make it possible to modify the stage spaces and, correspondingly, the spaces reserved for the audience reversibly without any need for performing permanent works or closing the theater house.

The invention claimed is:

1. A theater house comprising:

a stage and stalls, the stage and the stalls comprising respective portions located side by side and alternating to each other, the stage being at a greater height with respect to the stalls which comprise at least one seat secured in correspondence with said stalls; and a roofing movable between a retracted configuration wherein the roofing uncovers the stalls and an extended configuration wherein the roofing covers the stalls thus defining a walking surface on the roofing adjacent to the stage, said roofing comprising a plurality of panels movable between a first position wherein the panels lay in a position underneath a portion of stage and a second position wherein the panels lay on the at least one seat to cover said stalls.

2. The theater house according to claim 1, wherein the stage presents a housing space for the panel in the first position, the housing space being located under a stage walking surface.

3. The theater house according to claim 2, comprising a handling member acting onto the panels to move the panels between the first position and the second position.

4. The theater house according to claim 2, wherein the panels in the second position extend from a first portion of the stage that houses the panels to a second portion of the stage, opposite to the stalls, wherein the panels are resting.

5. The theater house according to claim 2, comprising a handling member acting onto the panels to move the panels between the first position and the second position.

6. The theater house according to claim 2, wherein the at least one seat is swivelingly secured to a walking surface of the stalls.

7. The theater house according to claim 2, wherein every portion of the stalls has portions of stage running side by side at an opposite side thereto.

8. The theater house according to claim 2, wherein the stage and the stalls develop according to respective spiral-like courses, the spiral-like course defining the stage and the spiral-like course defining the stalls being placed side by side to each other.

9. The theater house according to claim 1, wherein the panels in the second position extend from a first portion of the stage that houses the panels to a second portion of the stage, opposite to the stalls, wherein the panels are resting.

10. The theater house according to claim 9, comprising a handling member acting onto the panels to move the panels between the first position and the second position.

11. The theater house according to claim 9, wherein the at least one seat is swivelingly secured to a walking surface of the stalls.

12. The theater house according to claim 9, wherein every portion of the stalls has portions of stage running side by side at an opposite side thereto.

13. The theater house according to claim 9, wherein the stage and the stalls develop according to respective spiral-like courses, the spiral-like course defining the stage and the spiral-like course defining the stalls being placed side by side to each other.

14. The theater house according to claim 1, wherein the at least one seat comprises an upright, performing a structural function, secured to a walking surface of the stalls, each panel in the second position resting on an upright.

15. The theater house according to claim 14, wherein the at least one seat comprises a back and a seat secured to the upright.

16. The theater house according to claim 1, wherein the at least one seat is swivelingly secured to a walking surface of the stalls.

17. The theater house according to claim 1, wherein every portion of the stalls has portions of stage running side by side at an opposite side thereto.

18. The theater house according to claim 1, wherein the stage and the stalls develop according to respective spiral-like courses, the spiral-like course defining the stage and the spiral-like course defining the stalls being placed side by side to each other.

19. A theater house comprising:

a stage and a stall, the stage and stall located side by side, the stage being at a greater height with respect to the stall which comprises at least one seat secured in correspondence with the stall; and a roofing movable between a retracted configuration wherein the roofing uncovers the stall and an extended configuration wherein the roofing covers the stall thus defining a walking surface on the roofing adjacent to the stage, the roofing comprising a panel movable between a first position wherein the panel lays in a position underneath a portion of stage and a second position wherein the panel lays on the at least one seat to cover the stall.

20. The theater house according to claim 19, wherein the panel in the second position extends from a first portion of the stage that houses the panel to a second portion of the stage, opposite to the stall, wherein the panel is resting.

* * * * *